US007937897B2

(12) United States Patent
Kitagawa

(10) Patent No.: US 7,937,897 B2
(45) Date of Patent: May 10, 2011

(54) DOME-SHAPED SHELTER

(75) Inventor: Katsuyuki Kitagawa, Kaga (JP)

(73) Assignee: Yusenkaisha Japan Isusyc (JP)

( * ) Notice: Subject to any disclaimer, the term of this patent is extended or adjusted under 35 U.S.C. 154(b) by 187 days.

(21) Appl. No.: 12/161,855

(22) PCT Filed: Jan. 25, 2006

(86) PCT No.: PCT/JP2006/301160
§ 371 (c)(1),
(2), (4) Date: Jul. 23, 2008

(87) PCT Pub. No.: WO2007/086115
PCT Pub. Date: Aug. 2, 2007

(65) Prior Publication Data

US 2009/0013616 A1 Jan. 15, 2009

(51) Int. Cl.
*E04H 9/02* (2006.01)

(52) U.S. Cl. ..... 52/167.5; 52/80.1

(58) Field of Classification Search ..... 52/167.4, 52/167.5, 80.1, 81.4
See application file for complete search history.

(56) References Cited

U.S. PATENT DOCUMENTS

| | | | | |
|---|---|---|---|---|
| 845,046 | A * | 2/1907 | Bechtold | 52/167.5 |
| 2,166,577 | A * | 7/1939 | Beckius | 52/169.1 |
| 5,564,237 | A * | 10/1996 | Yoneda | 52/167.5 |
| 6,279,275 | B1 * | 8/2001 | Sawyer | 52/169.5 |
| 2002/0088193 | A1 * | 7/2002 | Reimers et al. | 52/403.1 |
| 2007/0096506 | A1 * | 5/2007 | Haack | 296/165 |

FOREIGN PATENT DOCUMENTS

| | | |
|---|---|---|
| JP | 3052858 | 10/1998 |
| JP | 11-141183 | 5/1999 |
| JP | 2000-001861 | 1/2000 |
| JP | 2004-211444 | 7/2004 |
| JP | 2005-315025 | 11/2005 |

* cited by examiner

*Primary Examiner* — Jeanette E Chapman
*Assistant Examiner* — Daniel Kenny
(74) *Attorney, Agent, or Firm* — Lowe Hauptman Ham & Berner, LLP

(57) ABSTRACT

The present invention proposes a dome-shaped shelter that has a seismic-isolation structure so as to reduce the shock effects of earthquakes and that is easy to construct. The dome-shaped shelter of the present invention is provided with (1) a dome affixed to a bottom board, and formed so as to surround an inside space with a floor, adjoining segments that form a wall, and adjoining segments that form a ceiling, all of which are made of expanded polystyrene, and (2) as an appropriate place for the dome, an improved ground that consists of a circular hole that is dug in ground to a predetermined depth and then packed with identical spheres. Said dome is slidably placed on said improved ground. The spheres of said improved ground are preferably cobblestones or made of hard rubber.

2 Claims, 3 Drawing Sheets

DOME-SHAPED SHELTER

CROSS-REFERENCE TO RELATED APPLICATIONS

The present application is based on International Application No. PCT/JP2006/301160 filed Jan. 25, 2006 and priority is hereby claimed under 35 USC §119 based on this application. This application is hereby incorporated by reference in its entirety into the present application.

TECHNICAL FIELD

The present invention relates to a dome-shaped shelter having a seismic isolation structure.

BACKGROUND ART

Foam polystyrene is commonly known as styrene foam or EPS (expanded polystyrene), which is made by allowing a polystyrene-resin-containing blowing agent such as butane or pentane to expand to about 50-100 times its original size, for example, in a die. In terms of volume, foam polystyrene is 98 percent air, which results in such characteristics as being light in weight and having both heat-insulating properties and strength. Specifically, foam polystyrene's density is 20 $kg/m^3$, and its strength is about 5000 $kg/m^2$. In other words, foam polystyrene is lightweight yet sturdy enough to support weight of 5 tons per square meter. A dome made of this kind of material can retain heat, tolerate shocks such as those from earthquakes, and is comfortable to be inside of. Also, foam polystyrene is useful as a cushioning material because it effectively disperses the force of impacts. Accordingly, one of its well-known uses is for sporting helmets.

In domes made of expanded polystyrene, earthquake-resistant structures having firm foundations have been adopted. For example, as shown in FIG. 4, the foundation of a sectionally assembled dome described in Patent Document 1 is constructed by connecting concrete blocks 80, each of which weighs about 200 kg, and laying them on the ground 70 in a circle. The lower ends of expanded polystyrene 1 segments that make up the dome 60 are fitted into a recess provided at the side of concrete blocks. The inner area of each concrete block is covered by a waterproof membrane, and then concrete 82 is placed on the membrane. This kind of structure, which well withstands earthquake shocks, corresponds to the continuous footing or mat foundation applied to wooden buildings. That is to say, if an earthquake occurs this kind of structure will not collapse, although it might shake violently. However, if a dome is used as a warehouse or the like, shaking due to an earthquake is likely to cause articles to fall off from shelves on which they are stacked. Moreover, if a dome is used as a place of safety, shaking due to an earthquake can cause people who have taken refuge in the dome to feel uneasy. Accordingly, what are required are domes made of expanded polystyrene to resist the shocks that result from earthquakes and to reduce such shaking.

Patent Document 1: Japanese Unexamined Patent Application Publication No. 2004-211444

DISCLOSURE OF THE INVENTION

Problems to be Solved by the Invention

The objective of the present invention is to overcome the limitations of the aforesaid prior art and to provide a dome-shaped shelter having a seismic-isolation structure.

Means for Solving the Problems

The dome-shaped shelter of the present invention consists of a dome that is affixed to a bottom board, and formed so as to surround an inside space by a floor, adjoining segments that form a wall, and adjoining segments that form a ceiling, all of which are made of expanded polystyrene, and as an appropriate place for the dome, a circular hole that is dug in the ground to a predetermined depth and then packed with identical spheres (hereinafter "improved ground"), and with said dome slidably placed on said improved ground.

The spheres of said improved ground are preferably cobblestones or made of hard rubber.

Effects of the Invention

Claim 1 of the present invention discloses a dome-shaped shelter that provides, as an appropriate place for the dome, an improved ground that is consists of said circular hole packed with identical spheres that absorb the horizontal shaking resulting from earthquakes, thereby reducing the shaking of the dome. Moreover, even if the improved ground moves horizontally, the dome that is affixed to the bottom board slides over the improved ground, which results in little movement of the dome itself. The dome's floor, wall, and ceiling are made of expanded polystyrene, and they form a closed structure like a shell. This provides proper cushioning and strength, and dissipates throughout the dome the shaking that results from earthquakes, thereby reducing the shock to people or goods inside the dome.

Claim 2 of the present invention discloses that the dome-shaped shelter is able to effectively absorb shaking by allowing the identical spheres—cobblestones or hard rubber—to move at their contact points, enabling the spheres to absorb effectively both the horizontal and vertical shaking of an earthquake. Identical spheres are also advantageous for leveling the improved ground.

BRIEF DESCRIPTIONS OF THE DRAWINGS

EXPLANATION OF REFERENCE NUMERALS USED IN THE DRAWINGS

Figure 1:
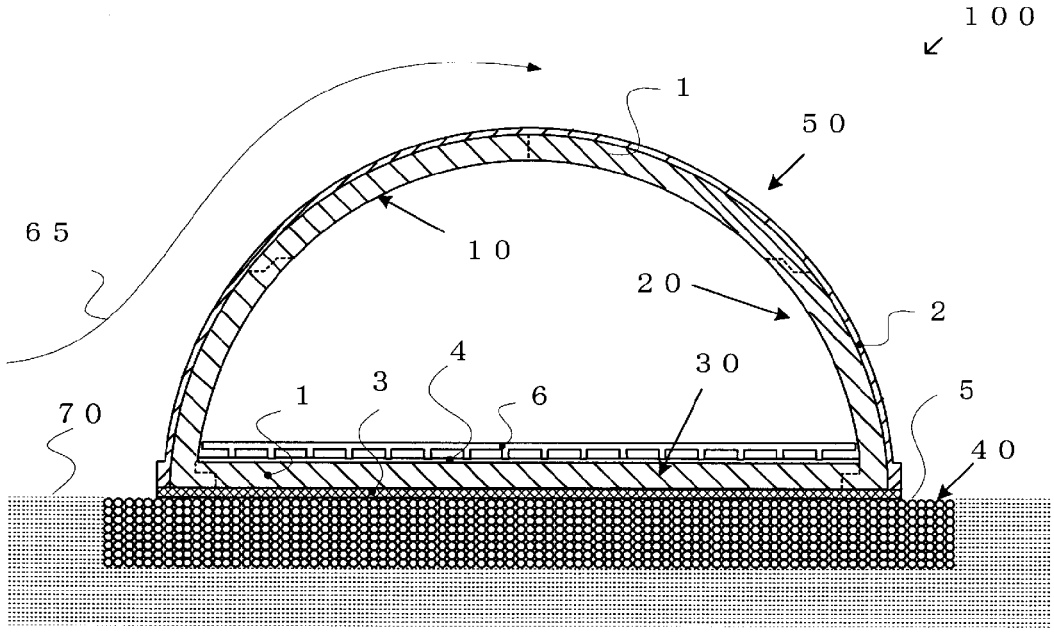
FIG. 1 is a cross-sectional view of a dome-shaped, earthquake-resistant shelter of the present invention. (Embodiment 1)

1 expanded polystyrene
2 reinforced-mortar layer
3 bottom board
4 concrete layer
5 cobblestones
6 upper floor
7 concrete formwork plywood
10 ceiling
15 adjoining ceiling-segment
20 wall
25 adjoining wall-segment
30 lower floor
40 improved ground
50 dome (present embodiment)

60 dome (conventional)
65 wind
70 ground
80 concrete blocks
82 concrete
100 dome-shaped shelter

BEST MODE FOR CARRYING OUT THE INVENTION

An embodiment of the present invention is described in detail below with reference to the drawings.

Embodiment

FIG. 1 is a cross-sectional view of the present invention's dome-shaped shelter 100, which is constructed by placing—on improved ground 40 made of cobblestones 5—a dome 50 that is formed of adjoining segments made of expanded polystyrene 1. The dome 50 has a closed structure that is formed by enclosing a space with a lower floor 30, walls 20, and a ceiling 10, with a bottom board 3 provided at the bottom of the dome 50 in such a way that the bottom board 3 contacts the improved ground 40. The expanded polystyrene 1, of which the dome 50 is made, is designed to be 20-cm thick so as ensure the durability of the dome 50 under various conditions, even if snow accumulates on the dome 50. The outer surface of the expanded polystyrene 1 is covered with a reinforced-mortar layer 2 that is about 2-cm thick. The reinforced-mortar layer 2 is made by combining mortar with a mixture of carbon fiber, which enhances resistance to shocks or cracks, and an acrylic resin adhesive, such as a polyacrylic acid ester or a polymethacrylic acid ester, which enhances the ability of the reinforced-mortar layer 2 to adhere to the expanded polystyrene 1.

Concrete formwork plywood is used here for the bottom board 3 so that the dome 50 can move slidably along the improved ground 40. Concrete formwork plywood having a thickness of 6 mm-9 mm is used for a formwork for concrete. Instead of concrete formwork plywood, resin can be used for the bottom board 3. A concrete layer 4 is provided above the lower floor 30, on which an upper floor 6 is provided. The space under the upper floor 6 can be used as a space for wiring and piping.

A circular hole having a depth of about 50 cm is dug in the ground 70 and is packed with cobblestones 5, which makes the improved ground 40. The cobblestones 5 are identical round stones having a diameter of 15 cm-30 cm. In general, rubble refers to small stones, often being round stones having a diameter of 10 cm-15 cm, gravel refers to stones having a diameter of 0.5 cm-8 cm, and boulder refers to a stone having a diameter of 30 cm or more. Rubble and gravel are prone to flow, and boulders do not effectively absorb the shaking resulting from earthquakes. The spheres suitable for use as improved ground 40 are not limited to cobblestones 5, but can be spheres of hard rubber having moderate hardness and elasticity. The diameter of the spheres is preferably 10 cm-30 cm.

Figure 2:
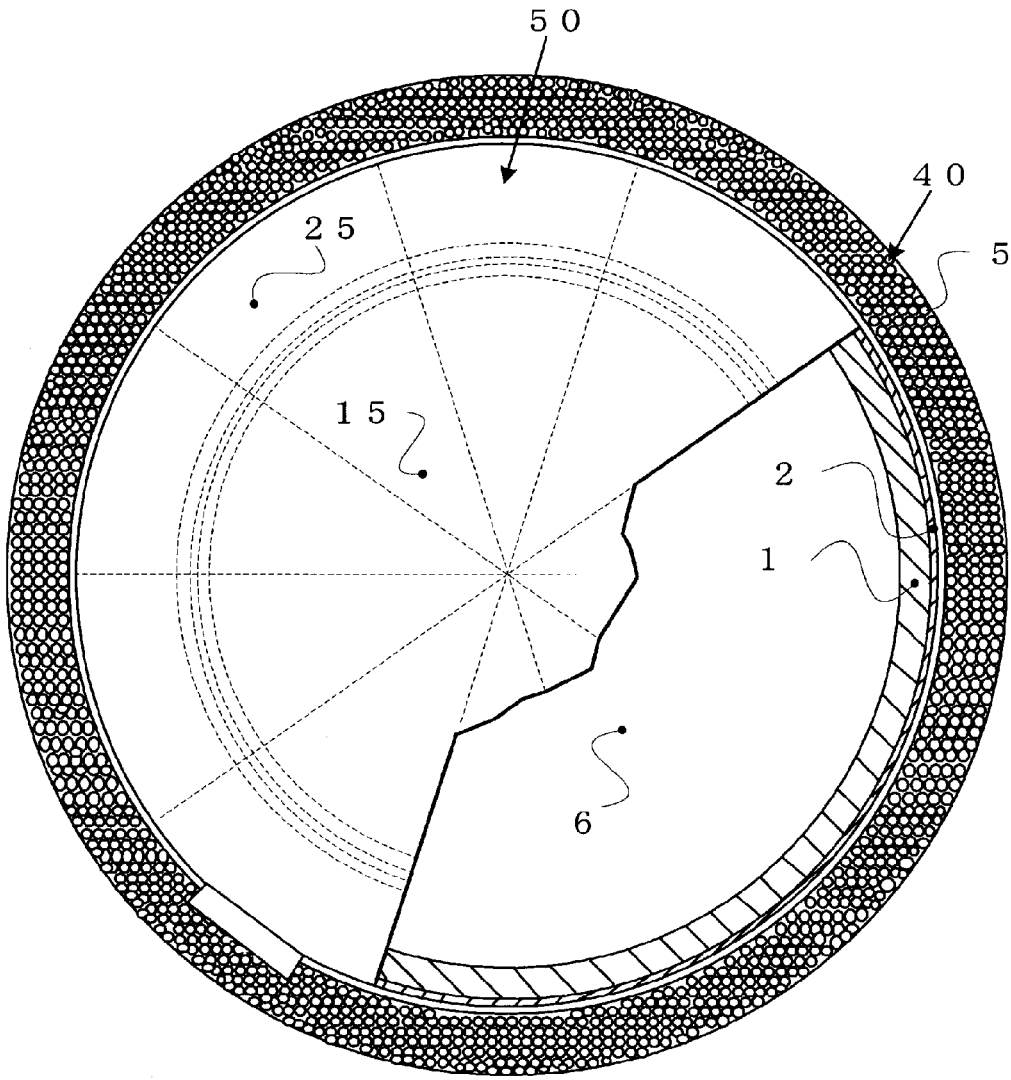
FIG. 2 is a plan view of the dome-shaped, earthquake-resistant shelter. (Embodiment 1)

FIG. 2 is a plan view of the dome-shaped shelter. FIG. 2 shows the inside of the dome 50 by cutting out the roof along the thick line and horizontally cutting the wall of the right lower side. The diameter of the floor of the dome 50 is about 7 m, and the diameter of the improved ground 40 is to be about 8 m, being 1 m larger than the diameter of the dome 50. The outer shell of the dome 50 consists of ten (10) adjoining wall-segments 25 and ten (10) adjoining ceiling-segments 15. Adjoining segments are bonded together by an adhesive, and their outsides are covered with a reinforced-mortar layer 2. Each adjoining wall-segment 25 and each corresponding adjoining ceiling-segment 15 can be joined together to form a single wall/ceiling adjoining segment. The lower floor 30 is also constructed by bonding together multiple adjoining segments, which are not illustrated.

Figure 3:
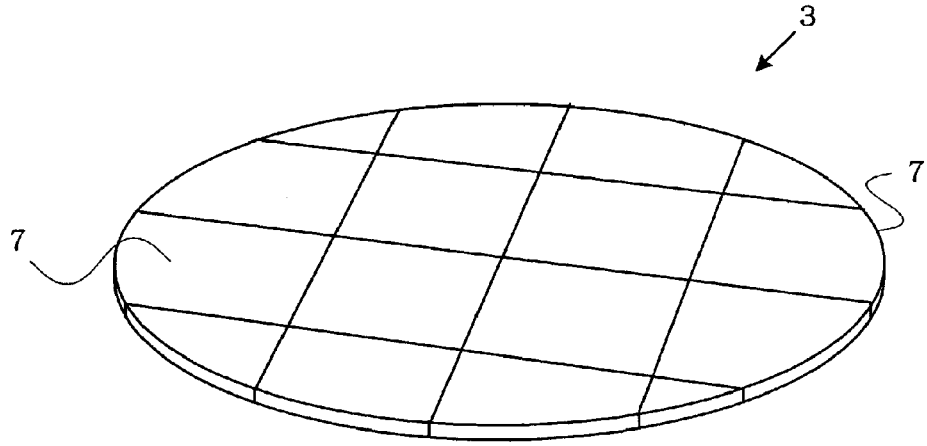
FIG. 3 is a perspective view of a bottom board. (Embodiment 1)
Figure 4:
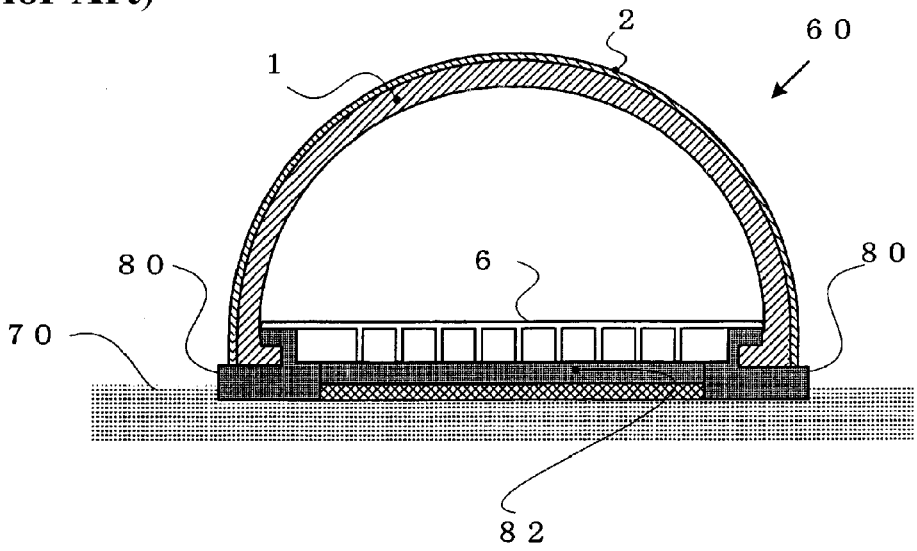
Fig. 4 (Prior Art)
FIG. 4 is a cross-sectional view of a conventional dome.

FIG. 3 is a perspective view of the bottom board 3, which is constructed by bonding together adjoining segments made of concrete formwork plywood 7. Adjoining segments are bonded together by reinforcement tapes and adhesives. The bottom board 3 is bonded, using an adhesive, to the lower floor 30, which is made of expanded polystyrene 1.

Even if the dome-shaped shelter 100 is put on improved ground 40, wind 65 will not lift the shelter off the ground. That is because any wind 65 that hits the dome-shaped shelter 100 flows over the roof of the dome 50 in a manner so as press down the roof, as shown in FIG. 1. Assuming that the specific gravity of mortar is 2.0, the dome 50 in this embodiment weighs about 700 kg, which is almost the same as the weight of a light vehicle, although the weight of the dome varies according to the thickness of the reinforced-mortar layer. Even if an earthquake or the like were to cause the dome to be dislocated from its original installation position, the dome can easily be moved back to the original position by jacking it up and moving it on rollers.

INDUSTRIAL APPLICABILITY

The dome-shaped shelter of the present invention has adopted a seismic isolation structure, and therefore the dome-shaped shelter is suitable not only for a dwelling house but also for a warehouse and the like.

What is claimed is:

1. A dome-shaped shelter comprising:

a dome including a lower floor, a wall and a ceiling, said dome affixed to a bottom board disposed under the lower floor, and said dome enclosing an inside space by bonding adjoining segments by an adhesive, said adjoining segments forming said lower floor, said wall and said ceiling, all of which are made of expanded polystyrene, and as an appropriate place for the dome, an improved ground including a circular hole that is dug in the ground to a predetermined depth and then entirely packed with identical spheres, wherein said wall and said ceiling are covered with a reinforced-mortar layer mixed with carbon fiber, said dome is slidably placed on said improved ground, and a level of a lower surface of said bottom board is equal to that of an upper surface of said improved ground.

2. The dome-shaped shelter according to claim 1, wherein said spheres of said improved ground are cobblestones or made of hard rubber.

* * * * *